US005813389A

United States Patent [19]

Kitamura et al.

[11] Patent Number: 5,813,389

[45] Date of Patent: Sep. 29, 1998

[54] CYLINDER-BY-CYLINDER AIR-FUEL RATIO-ESTIMATING SYSTEM FOR INTERNAL COMBUSTION ENGINES

[75] Inventors: Toru Kitamura; Akira Kato, both of Wako, Japan

[73] Assignee: Honda Giken Kogyo Kabushiki Kaisha, Minato-ku, Japan

[21] Appl. No.: 906,964

[22] Filed: Aug. 6, 1997

[30] Foreign Application Priority Data

Aug. 8, 1996 [JP] Japan ..... 8-224611

[51] Int. Cl.[6] ..... F02D 41/14

[52] U.S. Cl. ..... 123/673; 123/684; 123/687; 701/109

[58] Field of Search ..... 123/480, 672, 123/673, 684, 687; 701/103, 109; 73/116

[56] References Cited

U.S. PATENT DOCUMENTS 5,448,978 9/1995 Hasegawa et al. ..... 123/673 X
5,524,598 6/1996 Hasegawa et al. ..... 123/672
5,531,208 7/1996 Hasegawa et al. ..... 123/673
5,540,209 7/1996 Hasegawa et al. ..... 123/679
5,548,514 8/1996 Hasegawa et al. ..... 123/673 X
5,566,071 10/1996 Akazaki et al. ..... 123/672 X

*Primary Examiner*—Tony M. Argenbright
*Attorney, Agent, or Firm*—Nikaido, Marmelstein, Murray & Oram LLP

[57] ABSTRACT

A cylinder-by-cylinder air-fuel ratio-estimating system for an internal combustion engine includes an air-fuel ratio sensor arranged in the exhaust system of the engine, at a confluent portion of the exhaust system. The air-fuel ratio of a mixture supplied to each of the cylinders of the engine is estimated based on an output from the air-fuel ratio sensor, by using an observer for observing the internal operative state of the exhaust system based on a model representative of the behavior of the exhaust system. A gain for use in the estimation of the air-fuel ratio of the mixture supplied to each of the cylinders is estimated by the observer according to operating conditions of the engine.

4 Claims, 10 Drawing Sheets

LAF F/B
STARTING MODE ?
YES
NO
S1
CALCULATE KCMD,KCMDM
S2
SELECT LAF SENSOR OUTPUT
S3
CALCULATE KACT
S4
DETERMINE ACTIVAION LAF SENSOR
S5
DETERMINE LAF F/B REGION
S6
FKLAFRESET =1 ?
S7
YES
NO
S8
KLAF=1.0
KOBSV#N=KOBSV#Nsty
KLAFI=0
EXECUTE STARTING MODE PROCESS
CALCULATE KOBSV#N
S9
CALCULATE KLAF
S10
RETURN KOBSV#N CALCULATION
S331
FLFLNNG =1 ?
YES
NO
S332
KCMD=1.0 ?
YES
NO
ESTIMATE CYLINDER-BY-CYLINDER A/F
S336
S337
FKLAFHOLD =1 ?
YES
NO
S338
FKLAFRESET =1 ?
YES
NO
S339
NE>NOBSV ?
YES
NO
S340
PBA> PBOBSVH ?
YES
NO
S341
RETRIEVE PBOBSVL
S342
PBA< PBOBSVL ?
YES
NO
S344
KOBSV#N=1.0
S343
CALCULATE KOBSV#N, KOBSV#Nsty
RETURN

CYLINDER-BY-CYLINDER AIR-FUEL RATIO-ESTIMATING SYSTEM FOR INTERNAL COMBUSTION ENGINES

BACKGROUND OF THE INVENTION

1. Field of the Invention

This invention relates to a cylinder-by-cylinder air-fuel ratio-estimating system for internal combustion engines, which estimates the air-fuel ratio of a mixture supplied to each of cylinders of the engine by applying an observer based on a modern control theory.

2. Prior Art

Conventionally, there is known a cylinder-by-cylinder air-fuel ratio-estimating method for internal combustion engines, for example, from Japanese Laid-Open Patent Publication (Kokai) No. 5-180040, according to which an observer is set for observing the internal operative state of the exhaust system of the engine, based on a model describing the behavior of the exhaust system, and the air-fuel ratio of a mixture supplied to each of cylinders of the engine is estimated based on an output from an air-fuel ratio sensor arranged in the exhaust system at a confluent portion thereof, for generating an output proportional to the air-fuel ratio.

According to the above conventional method, in view of the fact that a parameter (weighting coefficient C) which defines a characteristic of the observer based on the model of the exhaust system varies depending on operating conditions of the engine, the parameter is changed depending on operating conditions of the engine.

To optimize characteristics of the observer irrespective of operating conditions of the engine, however, it does not always suffice to change the above parameter depending on operating condition of the engine. Therefore, the conventional method still remains to be improved in characteristics of the observer, particularly the stableness and convergence (converging speed) of the observer.

SUMMARY OF THE INVENTION

It is the object of the invention to provide a cylinder-by-cylinder air-fuel ratio-estimating system for internal combustion engines, which is capable of improving the stableness and convergence of the observer irrespective of operating conditions of the engine.

To attain the object, the present invention provides a cylinder-by-cylinder air-fuel ratio-estimating system for an internal combustion engine having a plurality of cylinders, and an exhaust system including at least one confluent portion, the cylinder-by-cylinder air-fuel ratio-estimating system including air-fuel ratio-detecting means arranged in the exhaust system at the confluent portion, and cylinder-by-cylinder air-fuel ratio-estimating means for estimating an air-fuel ratio of a mixture supplied to each of the cylinders, based on an output from the air-fuel ratio-detecting means, by using an observer for observing an internal operative state of the exhaust system based on a model representative of a behavior of the exhaust system.

The cylinder-by-cylinder air-fuel ratio-estimating system is characterized by an improvement wherein:

the cylinder-by-cylinder air-fuel ratio-estimating means changes a gain for use in the estimation of the air-fuel ratio of the mixture supplied to the each of the cylinders by the observer, according to operating conditions of the engine.

Preferably, the cylinder-by-cylinder air-fuel ratio-estimating means changes the gain for use in the estimation of the air-fuel ratio of the mixture supplied to the each of the cylinders by the observer, according to rotational speed of the engine and pressure within the intake system of the engine.

More preferably, the cylinder-by-cylinder air-fuel ratio-estimating means sets the gain to a larger value as the rotational speed of the engine increases and/or the pressure within the intake system decreases.

The above and other objects, features, and advantages of the invention will become more apparent from the following detailed description taken in conjunction with the accompanying drawings.

DETAILED DESCRIPTION

The invention will now be described in detail with reference to the drawings showing embodiments thereof.

Figure 1:
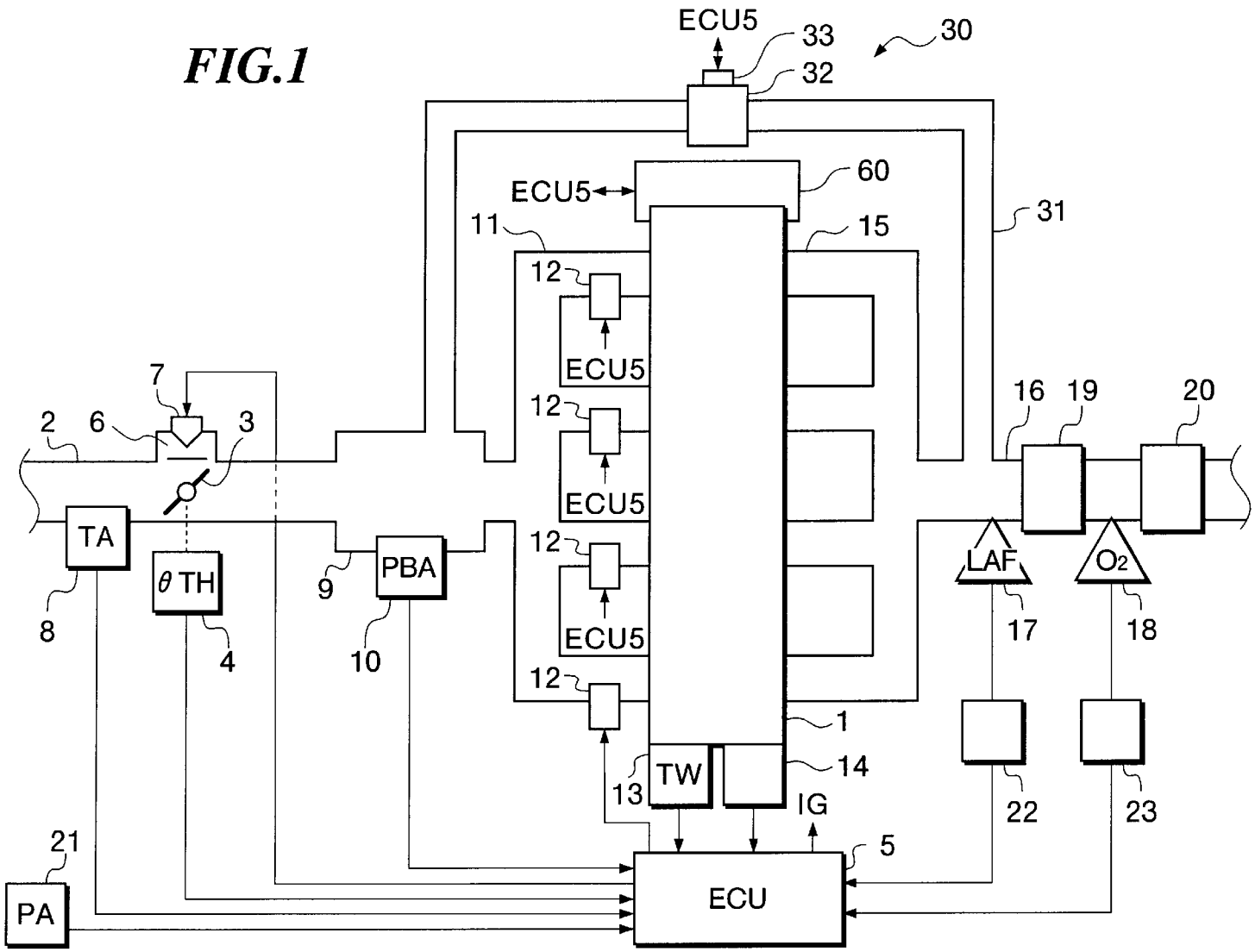
FIG. 1 is a block diagram showing the arrangement of an internal combustion engine and an air-fuel ratio control system therefor, including a cylinder-by-cylinder air-fuel ratio-estimating system according to an embodiment of the invention.

Referring first to FIG. 1, there is schematically shown the whole arrangement of an internal combustion engine and a control system therefor, including a cylinder-by-cylinder air-fuel ratio-estimating system according to a first embodiment of the invention. In the figure, reference numeral 1 designates a four-cylinder type internal combustion engine (hereinafter simply referred to as "the engine") having a pair of intake valves and a pair of exhaust valves provided for each cylinder, neither of which are shown.

The engine 1 has an intake pipe 2 having a manifold part (intake manifold) 11 directly connected to the combustion chamber of each cylinder. A throttle valve 3 is arranged in the intake pipe 2 at a location upstream of the manifold part 11. A throttle valve opening (θTH) sensor 4 is connected to the throttle valve 3, for generating an electric signal indicative of the sensed throttle valve opening θTH and supplying the same to an electronic control unit (hereinafter referred to as "the ECU") 5. The intake pipe 2 is provided with an auxiliary air passage 6 bypassing the throttle valve 3, and an auxiliary air amount control valve (electromagnetic valve) 7 is arranged across the auxiliary air passage 6. The auxiliary air amount control valve 7 is electrically connected to the ECU 5 to have an amount of opening thereof controlled by a signal therefrom.

An intake air temperature (TA) sensor 8 is inserted into the intake pipe 2 at a location upstream of the throttle valve 3, for supplying an electric signal indicative of the sensed intake air temperature TA to the ECU 5. The intake pipe 2 has a swelled portion 9 as a chamber interposed between the throttle valve 3 and the intake manifold 11. An intake pipe absolute pressure (PBA) sensor 10 is arranged in the chamber 9, for supplying a signal indicative of the sensed intake pipe absolute pressure PBA to the ECU 5.

An engine coolant temperature (TW) sensor 13, which may be formed of a thermistor or the like, is mounted in the cylinder block of the engine 1 filled with an engine coolant, for supplying an electric signal indicative of the sensed engine coolant temperature TW to the ECU 5. A crank angle position sensor 14 for detecting the rotational angle of a crankshaft, not shown, of the engine 1 is electrically connected to the ECU 5 for supplying an electric signal indicative of the sensed rotational angle of the crankshaft to the ECU 5.

The crank angle position sensor 14 is comprised of a cylinder-discriminating sensor, a TDC sensor, and a CRK sensor. The cylinder-discriminating sensor generates a signal pulse (hereinafter referred to as "a CYL signal pulse") at a predetermined crank angle of a particular cylinder of the engine 1, the TDC sensor generates a signal pulse at each of predetermined crank angles (e.g. whenever the crankshaft rotates through 180 degrees when the engine is of the 4-cylinder type) which each correspond to a predetermined crank angle before a top dead point (TDC) of each cylinder corresponding to the start of the suction stroke of the cylinder, and the CRK sensor generates a signal pulse at each of predetermined crank angles (e.g. whenever the crankshaft rotates through 30 degrees) with a predetermined repetition period shorter than the repetition period of TDC signal pulses. The CYL signal pulse, TDC signal pulse, and CRK signal pulse are supplied to the ECU 5, which are used for controlling various kinds of timing, such as a fuel injection timing and an ignition timing, and for detecting the engine rotational speed NE.

Fuel injection valves 12 are inserted into the intake manifold 11 for respective cylinders at locations slightly upstream of the intake valves. The fuel injection valves 12 are connected to a fuel pump, not shown, and electrically connected to the ECU 5 to have the fuel injection timing and fuel injection periods (valve opening periods) thereof controlled by signals therefrom. Spark plugs, not shown, of the engine 1 are also electrically connected to the ECU 5 to have the ignition timing θIG thereof controlled by signals therefrom.

An exhaust pipe 16 of the engine has a manifold part (exhaust manifold) 15 directly connected to the combustion chambers of the cylinders of the engine 1. A linear output oxygen concentration sensor (hereinafter referred to as "the LAF sensor") 17 is arranged in a confluent portion of the exhaust pipe 16 at a location immediately downstream of the exhaust manifold 15. Further, a first three-way catalyst (immediate downstream three-way catalyst) 19 and a second three-way catalyst (bed-downstream three-way catalyst) 20 are arranged in the confluent portion of the exhaust pipe 16 at locations downstream of the LAF sensor 17, for purifying noxious components present in exhaust gases, such as HC, CO, and NOx. An oxygen concentration sensor (hereinafter referred to as "the O2 sensor") 18 is inserted into the exhaust pipe 16 at a location intermediate between the three-way catalysts 19 and 20.

The LAF sensor 17 is electrically connected via a low-pass filter 22 to the ECU 5, for supplying the ECU 5 with an electric signal substantially proportional in value to the concentration of oxygen present in exhaust gases from the engine (i.e. the air-fuel ratio). The O2 sensor 18 has an output characteristic that output voltage thereof drastically changes when the air-fuel ratio of a mixture supplied to the engine changes across a stoichiometric air-fuel ratio to deliver a high level signal when the mixture is richer than the stoichiometric air-fuel ratio, and a low level signal when the mixture is leaner than the same. The O2 sensor 18 is electrically connected via a low-pass filter 23 to the ECU 5 for supplying the ECU 5 with the high or low level signal.

The engine 1 is provided with an exhaust gas recirculation (EGR) system 30 which is comprised of an exhaust gas recirculation passage 31 extending between the chamber 9 of the intake pipe 2 and the exhaust pipe 16, an exhaust gas recirculation control valve (hereinafter referred to as "the EGR valve") 32 arranged across the exhaust gas recirculation passage 31, for controlling the amount of exhaust gases to be recirculated, and a lift sensor 33 for detecting the lift of the EGR valve 32 and supplying a signal indicative of the detected valve lift to the ECU 5. The EGR valve 32 is an electromagnetic valve having a solenoid which is electrically connected to the ECU 5, the valve lift of which is linearly changed by a control signal from the ECU 5.

The engine 1 includes a valve timing changeover mechanism 60 which changes valve timing of at least the intake valves out of the intake valves and exhaust valves between a high speed valve timing suitable for a high speed operating region of the engine and a low speed valve timing suitable for a low speed operating region of the same. The changeover of the valve timing includes not only timing of opening and closing of the valve but also changeover of the valve lift amount, and further, when the low speed valve timing is selected, one of the two intake valves is disabled, thereby ensuring stable combustion even when the air-fuel ratio of the mixture is controlled to a leaner value than the stoichiometric air-fuel ratio.

The valve timing changeover mechanism 60 changes the valve timing by means of hydraulic pressure, and an electromagnetic valve for changing the hydraulic pressure and a hydraulic pressure sensor, neither of which is shown, are electrically connected to the ECU 5. A signal indicative of the sensed hydraulic pressure is supplied to the ECU 5 which in turn controls the electromagnetic valve for changing the valve timing.

Further electrically connected to the ECU 5 is an atmospheric pressure (PA) sensor 21, for detecting atmospheric pressure PA, and supplying a signal indicative of the sensed atmospheric pressure PA to the ECU 5.

The ECU 5 is comprised of an input circuit having the functions of shaping the waveforms of input signals from various sensors mentioned above, shifting the voltage levels of sensor output signals to a predetermined level, converting analog signals from analog-output sensors to digital signals, and so forth, a central processing unit (hereinafter referred to as "the CPU"), a memory circuit comprised of a ROM storing various operational programs which are executed by the CPU and various maps, referred to hereinafter, and a RAM for storing results of calculations from the CPU, etc., and an output circuit which outputs driving signals to the fuel injection valves 12 and other electromagnetic valves, the spark plugs, etc.

The ECU 5 operates in response to the above-mentioned signals from the sensors to determine operating conditions in which the engine 1 is operating, such as an air-fuel ratio feedback control region in which air-fuel ratio feedback control is carried out in response to outputs from the LAF sensor 17 and the O2 sensor 18, and air-fuel ratio open-loop control regions, and calculates, based upon the determined engine operating conditions, the fuel injection period TOUT over which the fuel injection valves 12 are to be opened, by the use of the following equation (1), to output signals for driving the fuel injection valves 12, based on the results of the calculation:

$$TOUT=TIMF\times KTOTAL\times KCMDM\times KLAF\times KOBSV\#N \quad (1)$$

where TIMF represents a basic value of the fuel injection amount TOUT, KTOTAL a correction coefficient, KCMDM a final desired air-fuel ratio coefficient, KLAF a PID correction coefficient, and KOBSV#N a cylinder-by-cylinder correction coefficient, respectively.

Figure 2:
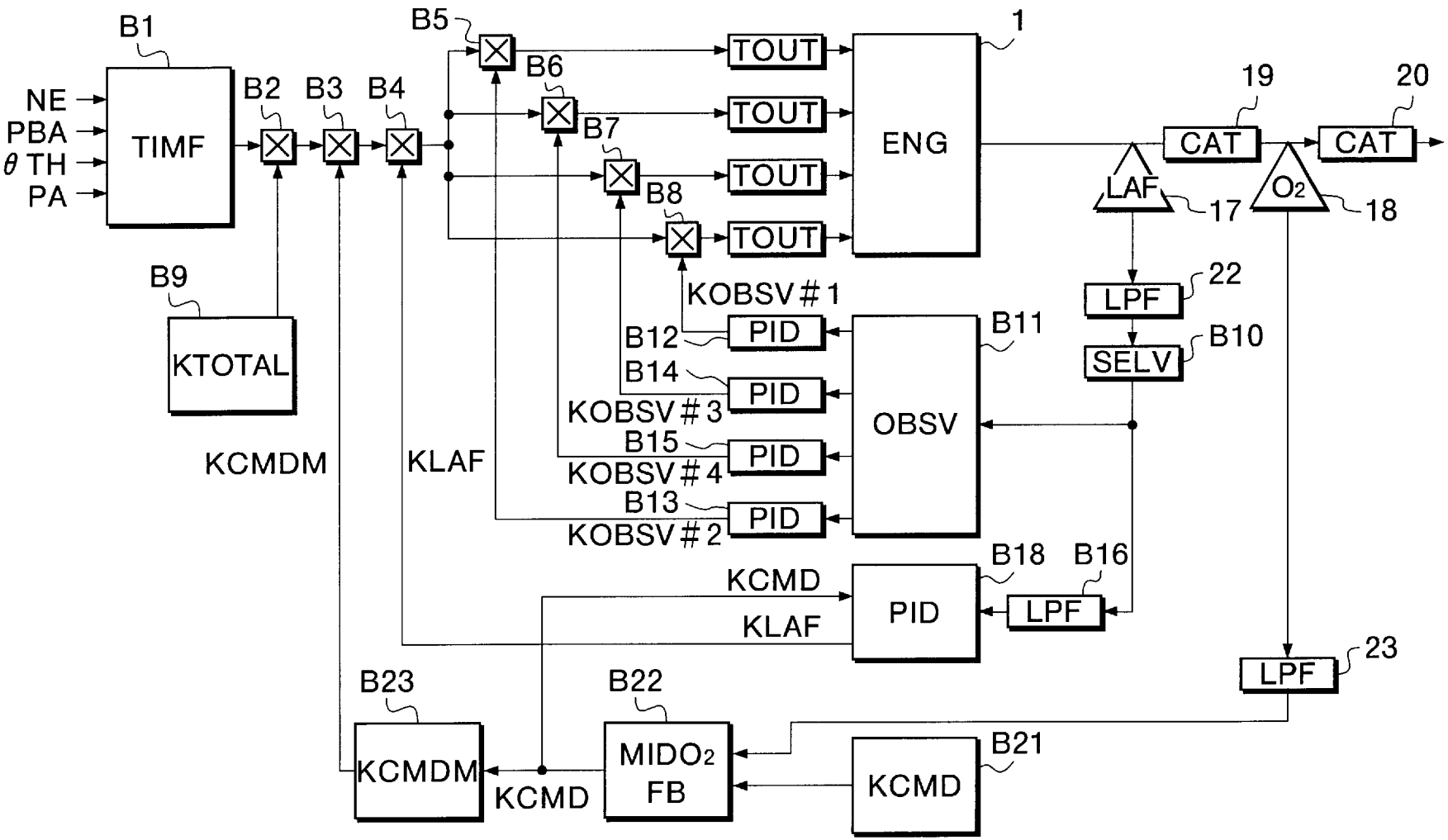
FIG. 2 is a block diagram useful in explaining a manner of controlling the air-fuel ratio of a mixture supplied to the engine.

FIG. 2 is a block diagram useful in explaining a manner of calculating the fuel injection period TOUT by the use of the equation (1). With reference to the figure, an outline of the manner of calculating the fuel injection period TOUT according to the present embodiment will be described. It should be noted that in the present embodiment, the amount of fuel to be supplied to the engine is calculated, actually, in terms of a time period over which the fuel injection valve 6 is opened (fuel injection period), but in the present specification, the fuel injection period TOUT is referred to as the fuel injection amount or the fuel amount since the fuel injection period is equivalent to the amount of fuel injected or to be injected.

In FIG. 2, a block B1 calculates the basic fuel amount TIMF corresponding to an amount of intake air. The basic fuel amount TIMF is basically set according to the engine rotational speed NE and the intake pipe absolute pressure PBA. However, it is preferred that a model representative of a part of the intake system extending from the throttle valve 3 to the combustion chambers of the engine 1 is prepared in advance, and a correction is made to the basic fuel amount TIMF in dependence on a delay of the flow of intake air obtained based on the model. In this preferred method, the throttle valve opening θTH and the atmospheric pressure PA are also used as additional parameters indicative of operating conditions of the engine.

Reference numerals B2 to B4 designate multiplying blocks, which multiply the basic fuel amount TIMF by respective parameter values input thereto, and deliver the product values. These blocks carry out the arithmetic operation of the equation (1), to thereby output the fuel injection amount TOUT.

A block B9 multiplies together all feedforward correction coefficients, such as an engine coolant temperature-dependent correction coefficient KTW set according to the engine coolant temperature TW, an EGR-dependent correction coefficient KEGR set according to the amount of recirculation of exhaust gases during execution of the exhaust gas recirculation, and a purging-dependent correction coefficient KPUG set according to an amount of purged evaporative fuel during execution of purging by an evaporative fuel-processing system, not shown, of the engine, to obtain the correction coefficient KTOTAL, which is supplied to the block B2.

A block B21 determines a desired air-fuel ratio coefficient KCMD based on the engine rotational speed NE, the intake pipe absolute pressure PBA, etc., and supplies the same to a block B22. The desired air-fuel ratio coefficient KCMD is directly proportional to the reciprocal of the air-fuel ratio A/F, i.e. the fuel-air ratio F/A, and assumes a value of 1.0 when it is equivalent to the stoichiometric air-fuel ratio. For this reason, this value KCMD will be also referred to as the desired equivalent ratio. The block B22 corrects the desired air-fuel ratio coefficient KCMD based on the output VMO2 from the O2 sensor 18 supplied via the low-pass filter 23, and delivers the corrected KCMD value to blocks B18 and B23. The block B23 carries out fuel cooling-dependent correction of the corrected KCMD value to calculate the final desired air-fuel ratio coefficient KCMDM and supplies the same to the block B3.

A block B10 samples the output from the LAF sensor 17 supplied via the low-pass filter 22 with a sampling period in synchronism with generation of each CRK signal pulse, sequentially stores the sampled values in a ring buffer memory, not shown, and selects one of the stored values depending on operating conditions of the engine (LAF sensor output-selecting process), which was sampled at the optimum timing for each cylinder, to supply the selected value to a block B11 and the block B18 via a low-pass filter block B16. The LAF sensor output-selecting process eliminates the inconveniences that the air-fuel ratio, which changes every moment, cannot be accurately detected depending on the timing of sampling of the output from the LAF sensor 17, there is a time lag before exhaust gases emitted from the combustion chamber reach the LAF sensor 17, and the response time of the LAF sensor per se changes depending on operating conditions of the engine.

The block B11 has the function of a so-called observer, i.e. a function of estimating a value of the air-fuel ratio separately for each cylinder from the air-fuel ratio (of a mixture of exhaust gases emitted from the cylinders) detected at the confluent portion of the exhaust system by the LAF sensor 17, and supplying the estimated value to a corresponding one of blocks B12 to B15 associated, respectively, with the four cylinders. In FIG. 2, the block B12 corresponds to a cylinder #1, the block B13 to a cylinder #2, the block B14 to a cylinder #3, and the block B15 to a cylinder #4. The blocks B12 to B15 calculate the cylinder-by-cylinder correction coefficient KOBSV#N (N=1 to 4) by the PID control such that the air-fuel ratio of each cylinder (the value of the air-fuel ratio estimated by the observer B11 for each cylinder) becomes equal to a value of the air-fuel ratio detected at the confluent portion, and supply KOBSV#N values to the blocks B5 to B8, respectively.

The block B18 calculates the PID correction coefficient KLAF through PID control, based on the difference between the actual air-fuel ratio and the desired air-fuel ratio and supplies the KLAF value to the block B4.

As described above, in the present embodiment, the fuel injection amount TOUT is calculated cylinder by cylinder by applying to the equation (1) the PID correction coefficient KLAF which is calculated by the ordinary PID control according to the output from the LAF sensor 17, as well as applying to the same equation the cylinder-by-cylinder correction coefficient KOBSV#N which is set according to the air-fuel ratio of each cylinder estimated based on the output from the LAF sensor 17. Variations in the air-fuel ratio between the cylinders can be eliminated by the use of the cylinder-by-cylinder correction coefficient KOBSV#N to thereby improve the purifying efficiency of the catalysts and hence obtain good exhaust emission characteristics of the engine in various operating conditions.

In the present embodiment, the functions of the blocks appearing in FIG. 2 are realized by arithmetic operations executed by the CPU of the ECU 5, and details of the operations will be described with reference to program routines illustrated in the drawings.

Figure 3:
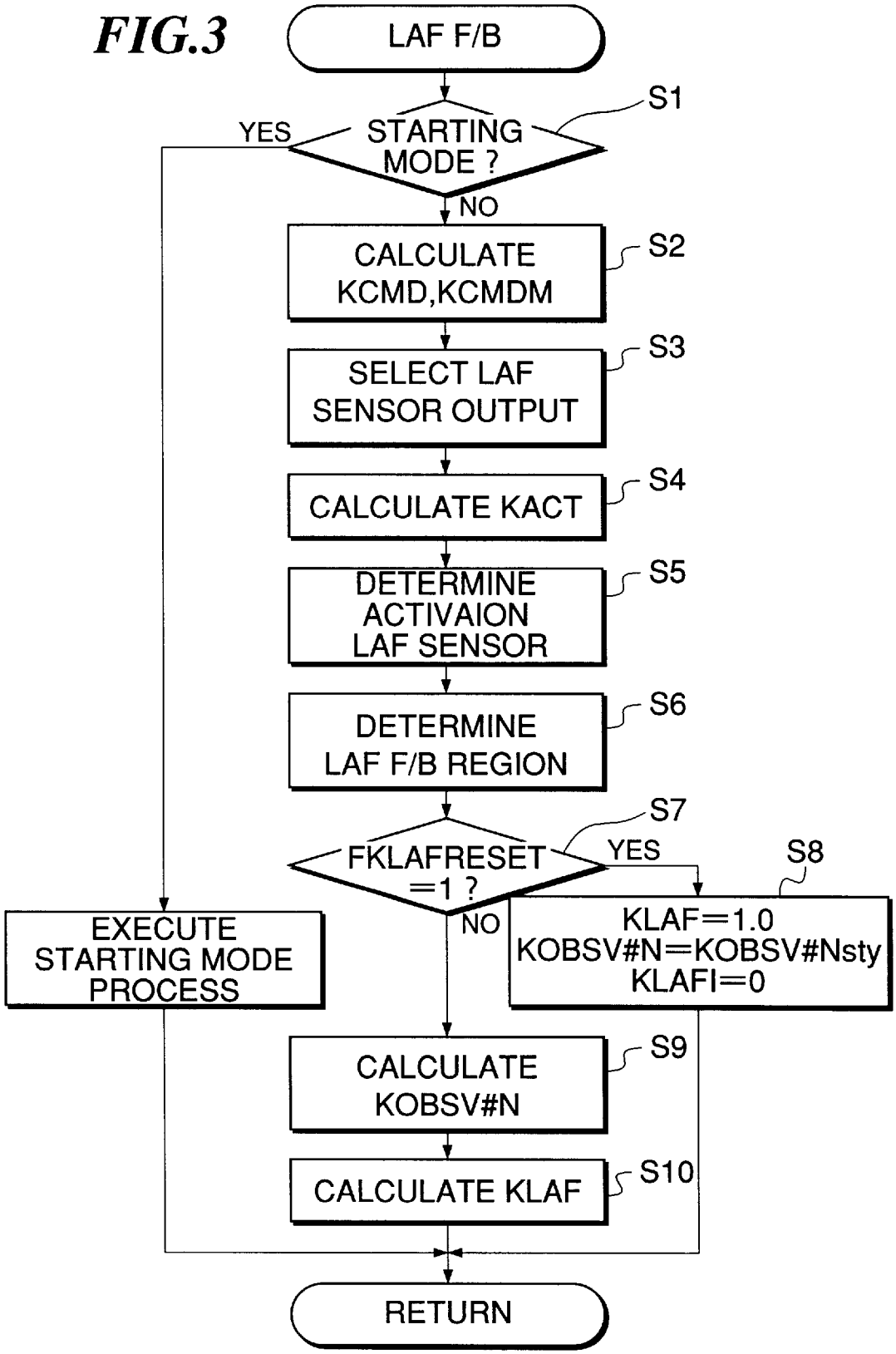
FIG. 3 is a flowchart showing a main routine for calculating a PID correction coefficient KLAF and a cylinder-by-cylinder correction coefficient KOBSV#N in response to an output from a LAF sensor appearing in FIG. 1.

FIG. 3 shows a main routine for calculating the PID correction coefficient KLAF and the cylinder-by-cylinder correction coefficient KOBSV#N according to the output from the LAF sensor 17. This routine is executed in synchronism with generation of TDC signal pulses.

At a step S1, it is determined whether or not the engine is in starting mode, i.e. whether or not the engine is cranking. If the engine is in the starting mode, the program proceeds to a step S14 to execute a subroutine for the starting mode, not shown. If the engine is not in the starting mode, the desired air-fuel ratio coefficient (desired equivalent ratio) KCMD and the final desired air-fuel ratio coefficient KCMDM are calculated at a step S2, and the LAF sensor output-selecting process is executed at a step S3. Further, an actual equivalent ratio KACT is calculated at a step S4. The actual equivalent ratio KACT is obtained by converting the output from the LAF sensor 17 to an equivalent ratio value.

Then, it is determined at a step S5 whether or not the LAF sensor 17 has been activated. This determination is carried out by comparing the difference between the output voltage from the LAF sensor 17 and a central voltage thereof with a predetermined value (e.g. 0.4 V), and determining that the LAF sensor 17 has been activated when the difference is smaller than the predetermined value.

Then, it is determined at a step S6 whether or not the engine 1 is in an operating region in which the air-fuel ratio feedback control responsive to the output from the LAF sensor 17 is to be carried out (hereinafter referred to as "the LAF feedback control region"). More specifically, it is determined that the engine 1 is in the LAF feedback control region, e.g. when the LAF sensor 17 has been activated but at the same time neither fuel cut nor wide open throttle operation is being carried out. If it is determined that the engine is not in the LAF feedback control region, a reset flag FKLAFRESET which, when set to "1", indicates that the engine is not in the LAF feedback control region, is set to "1", whereas if it is determined the engine is in the LAF feedback control region, the reset flag FKLAFRESET is set to "0".

At the following step S7, it is determined whether or not the reset flag FKLAFRESET assumes "1". If FKLAFRSET=1 holds, the program proceeds to a step S8, wherein the PID correction coefficient KLAF is set to "1.0", the cylinder-by-cylinder correction coefficient KOBSV#N is set to a learned value KOBSV#Nsty thereof, referred to hereinafter, and an integral term KLAFI used in the PID control is set to "0", followed by terminating the program.

On the other hand, if FKLAFRESET=0 holds at the step S7, the cylinder-by-cylinder correction coefficient KOBSV#N and the PID correction coefficient KLAF are calculated at respective steps S9 and S10, followed by terminating the present routine.

Next, description will be made of the manner of calculation of the cylinder-by-cylinder correction coefficient KOBSV#N executed at the step S9 in FIG. 3.

In the following description, first, a manner of estimating the cylinder-by-cylinder air-fuel ratio by the observer will be described, and then a manner of calculating the cylinder-by-cylinder correction coefficient KOBSV#N according to the estimated cylinder-by-cylinder air-fuel ratio will be described.

The air-fuel ratio detected at the confluent portion of the exhaust system is regarded as a weighted average value of air-fuel ratio values of the cylinders, which reflects time-dependent contributions of all the cylinders, whereby values of the air-fuel ratio detected at time points (k), (k+1), and (k+2) are expressed by equations (2A), (2B), and (2C), respectively. In preparing these equations, the fuel amount (F) was used as an operation amount, and accordingly the fuel-air ratio F/A is used in these equations:

$$[F/A](k) = C_1[F/A\#1] + C_2[F/A\#3] + C_3[F/A\#4] + C_4[F/A\#2] \tag{2A}$$

$$[F/A](k+1) = C_1[F/A\#3] + C_2[F/A\#4] + C_3[F/A\#2] + C_4[F/A\#1] \tag{2B}$$

$$[F/A](k+2) = C_1[F/A\#4] + C_2[F/A\#2] + C_3[F/A\#1] + C_4[F/A\#3] \tag{2C}$$

Figure 4:
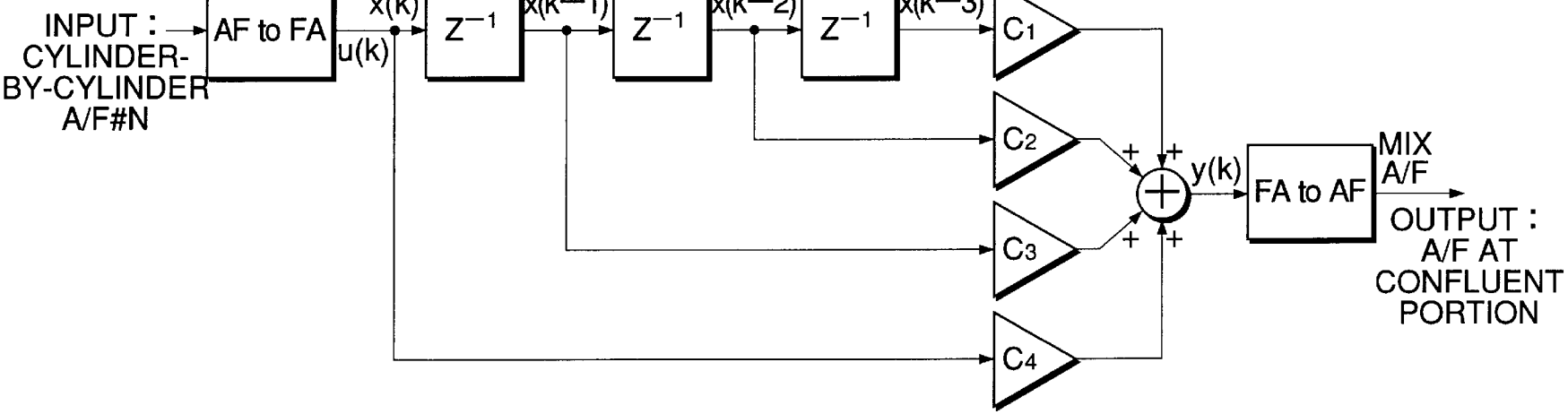
FIG. 4 is a block diagram showing a model representative of the behavior of the exhaust system of the engine.

More specifically, the fuel-air ratio detected at the confluent portion of the exhaust system is expressed as the sum of values of the cylinder-by-cylinder fuel-air ratio multiplied by respective weights C varying in the order of combustion (e.g. 40% for a cylinder corresponding to the immediately preceding combustion, 30% for one corresponding to the second preceding combustion, and so on). This model can be expressed in a block diagram as shown in FIG. 4, and the state equation therefor is expressed by the following equation (3):

$$\begin{bmatrix} x(k-2) \\ x(k-1) \\ x(k) \end{bmatrix} = \begin{bmatrix} 010 \\ 001 \\ 000 \end{bmatrix} \begin{bmatrix} x(k-3) \\ x(k-2) \\ x(k-1) \end{bmatrix} + \begin{bmatrix} 0 \\ 0 \\ 1 \end{bmatrix} u(k) \tag{3}$$

Further, if the fuel-air ratio detected at the confluent portion is designated by y(k), the output equation can be expressed by the following equation (4):

$$y(k) = [C_1 C_2 C_3] \begin{bmatrix} x(k-3) \\ x(k-2) \\ x(k-1) \end{bmatrix} C_4 u(k) \tag{4}$$

where, $C_1$, $C_2$, $C_3$, and $C_4$ represent weighting coefficients.

In the equation (4), u(k) cannot be observed, and hence an observer designed based on this state equation cannot perform observation of x(k). Therefore, on the assumption that a value of the air-fuel ratio detected four TDC signal pulses earlier (i.e. the immediately preceding value for the same cylinder) represents a value obtained under a steady operating condition of the engine without any drastic change in the air-fuel ratio, it is regarded that x(k+1)=x(k−3), whereby the equation (4) can be changed into the following equation (5):

$$\begin{bmatrix} x(k-2) \\ x(k-1) \\ x(k) \\ x(k+1) \end{bmatrix} = \begin{bmatrix} 0100 \\ 0010 \\ 0001 \\ 1000 \end{bmatrix} \begin{bmatrix} x(k-3) \\ x(k-2) \\ x(k-1) \\ x(k) \end{bmatrix} \tag{5}$$

-continued $$y(k) = [C_1C_2C_3C_4]\begin{bmatrix} x(k-3) \\ x(k-2) \\ x(k-1) \\ x(k) \end{bmatrix}$$

It has been empirically ascertained that the thus set model well represents the exhaust system of a four-cylinder type engine. Therefore, a problem arising from estimating the cylinder-by-cylinder air-fuel ratio from the air-fuel ratio A/F at the confluent portion of the exhaust system is the same as a problem with an ordinary Kalman filter used in observing x(k) by the following state equation and output equation (6). If weight matrices Q, R are expressed by the following equation (7), the Riccati's equation can be solved to obtain a gain matrix K represented by the following equation (8):

$$X(k+1)=AX(k)+Bu(k)\ y(k)=CX(k)+Du(k) \tag{6}$$

where $$A = \begin{bmatrix} 0100 \\ 0010 \\ 0001 \\ 1000 \end{bmatrix} C = [C_1C_2C_3C_4]\ B = D = [0]$$

$$X(k) = \begin{bmatrix} x(k-3) \\ x(k-2) \\ x(k-1) \\ x(k) \end{bmatrix}$$

$$Q = \begin{bmatrix} 1000 \\ 0100 \\ 0010 \\ 0001 \end{bmatrix} R = [1] \tag{7}$$

$$K = \begin{bmatrix} K1 \\ K2 \\ K3 \\ K4 \end{bmatrix} \tag{8}$$

Figure 11:
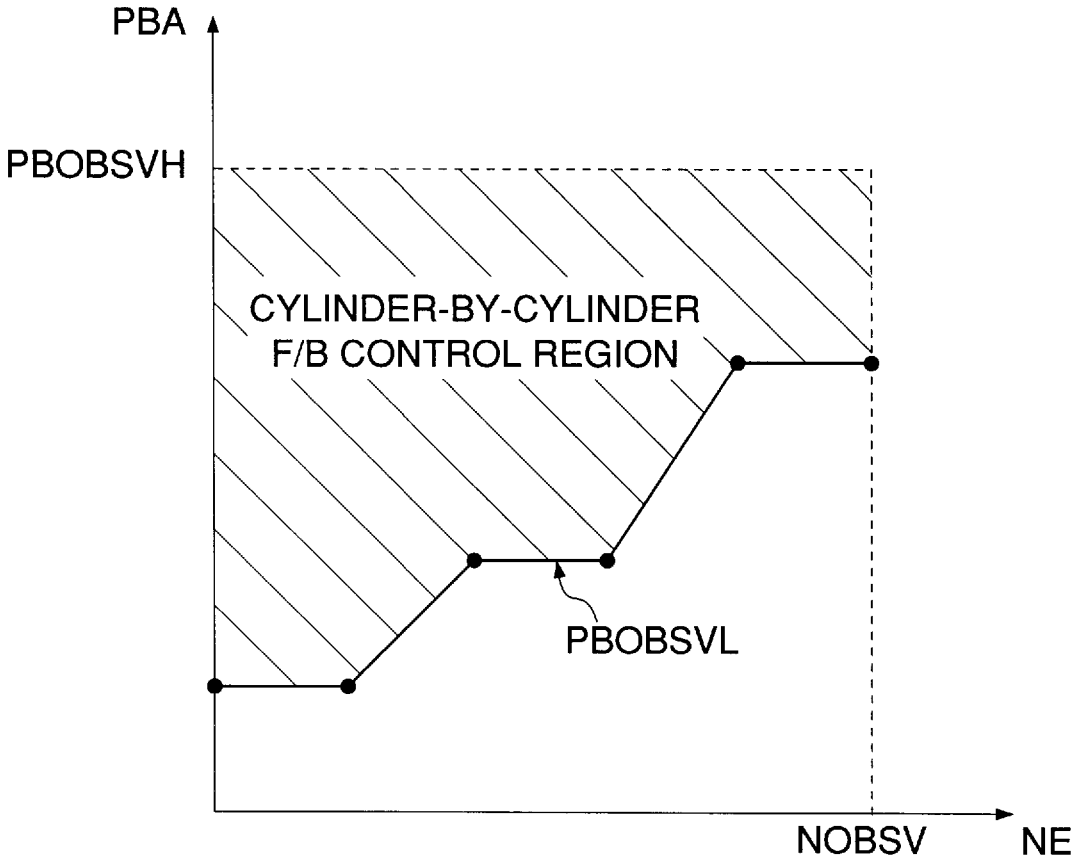
FIG. 11 is a diagram which is useful in explaining a cylinder-by-cylinder feedback control region.

In the model of the present embodiment, there is no inputting of u(k) which is input to an observer of a general type, so that the observer of the present embodiment is constructed such that y(k) alone is input thereto as shown in FIG. 11, which is expressed by the following equation (9):

$$\begin{aligned} \hat{X}(k+1) &= [A-KC]\hat{X}(k)+Ky(k) \\ &= A\hat{X}(k)+K(y(k)-C\hat{X}(k)) \\ \hat{x}(k) &= \begin{bmatrix} \hat{x}(k-3) \\ \hat{x}(k-2) \\ \hat{x}(k-1) \\ \hat{x}(k) \end{bmatrix} \end{aligned} \tag{9}$$

Therefore, from the fuel-air ratio y(k) at the confluent portion and the estimated value XΛ(k) of the cylinder-by-cylinder fuel-air ratio obtained in the past, the estimated value xΛ(k+1) of the same in the present loop can be calculated.

When the above equation (9) is employed to calculate the cylinder-by-cylinder fuel-air ratio xΛ (k+1), the actual equivalent ratio KACT(k) is substituted for the fuel-air ratio y(k) at the confluent portion. However, the actual equivalent ratio KACT(k) contains the response delay of the LAF sensor 17, whereas the CXΛ(k) value (weighted sum of four cylinder-by-cylinder fuel-air ratio values) does not contain the response delay. Therefore, the cylinder-by-cylinder fuel-air ratio cannot be accurately estimated by the use of the equation (9), due to the influence of the response delay of the LAF sensor 17. Especially, at a high engine rotational speed NE when time intervals at which TDC signal pulses are generated are shorter, the influence of the response delay upon the accuracy of the estimation is large.

According to the present embodiment, therefore, an estimated value yΛ(k) of the fuel-air ratio at the confluent portion is calculated by the use of the following equation (10), and the thus calculated value y Λ(k) is applied to the following equation (11), to thereby calculate the estimated value XΛ(k+1) of the cylinder-by-cylinder fuel-air ratio:

$$\hat{y}(k)=DL\hat{y}\ (k-1)+(1-DL)\ C\hat{X}\ (k) \tag{10}$$

$$\hat{X}\ (k+1)=A\hat{X}\ (k)+K\ (y\ (k)-\hat{y}\ (k)) \tag{11}$$

In the above equation (10), DL represents a parameter corresponding to a time constant of the response delay of the LAF sensor 17. In the above equations (10) and (11), an initial vector of the XΛ(k) value should be set such that component elements thereof (xΛ(k−3), xΛ(k−2), xΛ(k−1)) all assume a vector of 1.0, and in the equation (10), an initial value of the estimated value yΛ(k−1) is set to 1.0.

By thus using the equation (11) which is obtained by replacing the CXΛ(k) in the equation (9) by the estimated value yΛ(k) of the fuel-air ratio at the confluent portion containing the response delay, the response delay of the LAF sensor can be properly compensated for, to thereby carry out accurate estimation of the cylinder-by-cylinder air-fuel ratio. In the following description, estimated equivalent ratio values KACT#1(k) to KACT#4(k) for the respective cylinders correspond to the xΛ(k) value.

Next, the manners of setting the gain matrix K, the weighting coefficient C, and the delay time constant DL will be described in detail.

Figure 5:
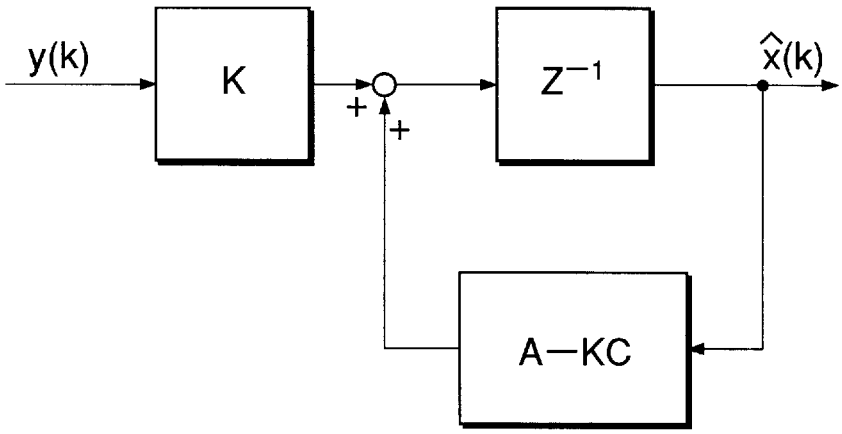
FIG. 5 is a block diagram showing the construction of an observer, which is applied to the model of the exhaust system.

Once the weighting coefficient C (C1, C2, C3, C4) has been set, the gain matrix K can be determined in general by solving the Riccati's equation, as mentioned above. The value of the gain for use in the estimation of the air-fuel ratio of each cylinder by the observer, however, needs to be changed according to operating conditions of the engine. For example, as the engine rotational speed NE decreases and/or the intake pipe absolute pressure PBA increases, it becomes more difficult for exhaust gases emitted from the cylinders to be mixed with each other so that the air-fuel ratio A/F at the confluent portion assumes a value closer to the air-fuel ratio of exhaust gases emitted from the cylinder corresponding to the immediately preceding combustion. Therefore, as the engine rotational speed NE decreases and/or the intake pipe absolute pressure PBA increases, the gain should be set to a smaller value, to thereby enhance the stableness of the air-fuel ratio A/F at the confluent portion. Conversely, as the engine rotational speed NE increases and/or the intake pipe absolute pressure PBA decreases, it becomes easier for exhaust gases emitted from the cylinders to be mixed with each other so that the air-fuel ratio A/F at the confluent portion is influenced by the air-fuel ratio of exhaust gases emitted from the cylinder before the cylinder corresponding to the immediately preceding combustion. The gain should be increased to enhance the convergence of the air-fuel ratio A/F. As is apparent from FIG. 5B and the equation (9), the value of the gain for use in the estimation of the air-fuel ratio of each cylinder is determined based on the weighting coefficient C and the gain matrix K. Therefore, the weighting coefficient C and the gain matrix K should be set according to operating conditions of the engine.

Figure 6A:
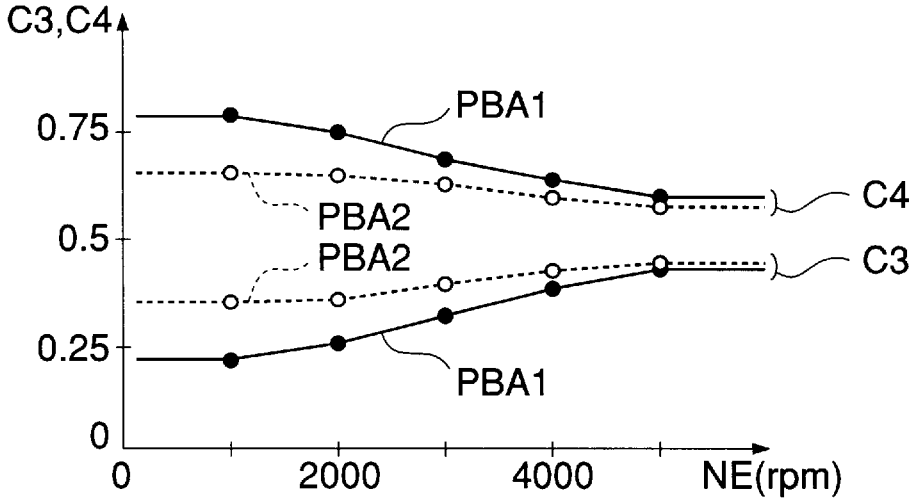
FIG. 6A shows a table for determining a weighting coefficient C for the observer.
Figure 7A:
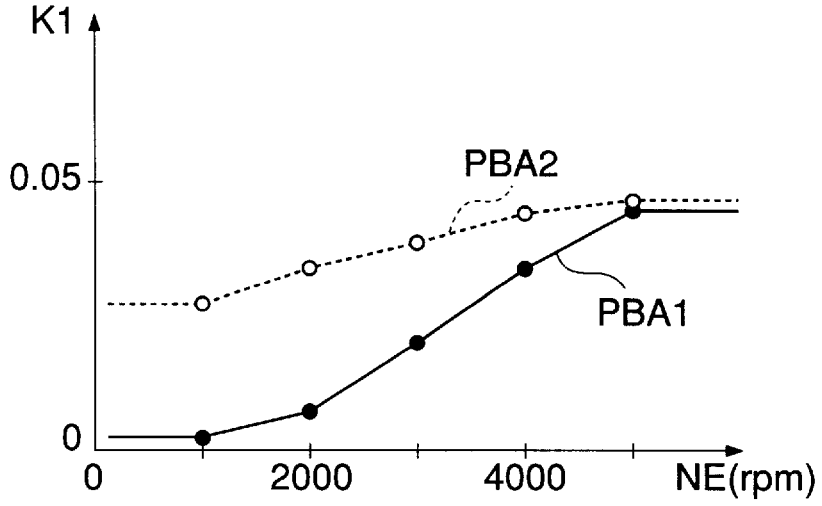
FIG. 7A shows a table for determining an element K1 of a gain matrix K for the observer.
Figure 7B:
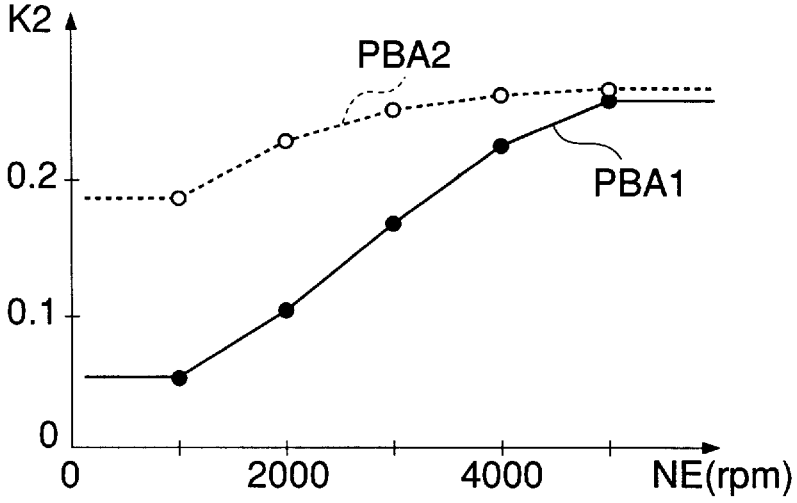
FIG. 7B shows a table for determining an element K2 of the gain matrix K.
Figure 7C:
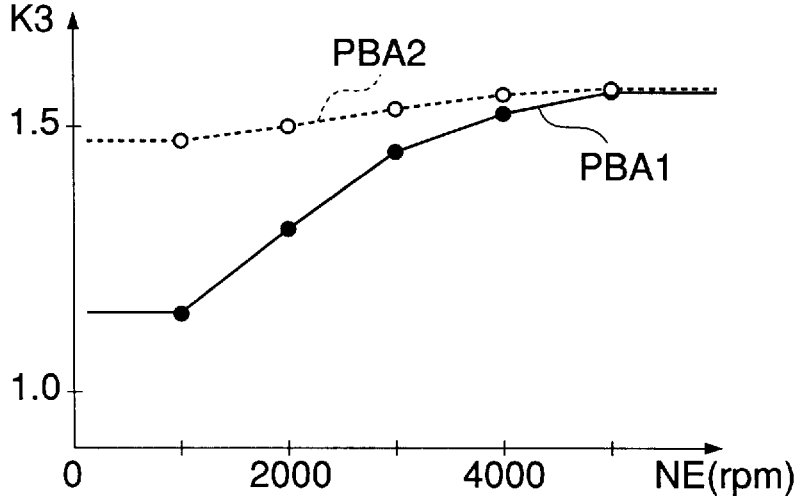
FIG. 7C shows a table for determining an element K3 of the gain matrix K.

In the present embodiment, two cylinders corresponding to the earliest and second earliest combustions are assumed not to influence the air-fuel ratio A/F at the confluent portion, and accordingly the respective weighting coefficients C1 and C2 are both set to 0. On the other hand, the cylinder corresponding to the immediately preceding combustion and the cylinder corresponding to the second preceding combustion are assumed to influence the air-fuel ratio A/F at the confluent portion, and accordingly the respective weighting coefficients C3 and C4 are determined from a C table shown in FIG. 6A, which is set according to the engine rotational speed NE and the intake pipe absolute pressure PBA. Further, elements K1 to K3 of the gain matrix K are determined from K tables shown in FIGS. 7A to 7C, which are set according to the engine rotational speed NE and the intake pipe absolute pressure PBA. The element K4 is set in the relationship K4=−K2. In FIGS. 7A to 7C, PBA1 and PBA2 represent 660 mmHg and 260 mmHg, respectively, for example, and an interpolation is carried out when the NE and/or PBA value falls between the predetermined values, to thereby calculate the weighting coefficients C3 and C4, and the gain matrix elements K1 to K4. In the present embodiment, the weighting coefficient C and the gain matrix K are calculated by the use of the separate tables, but this is not limitative. Alternatively, only the weighting coefficient C may be determined based on the C table, and the gain matrix K may be calculated by the use of the above-mentioned equation.

The C table is set such that the weighting coefficient C3 is set to a larger value as the NE value increases and/or the PBA value decreases, while the weighting coefficient C4 is set to a smaller value as the NE value increases and/or the PBA value decreases. Further, the K tables are set such that the K1, K2 and K3 values are all set to larger values as the NE value increases and/or the PBA value decreases. By the above setting, the gain for use in the estimation of the air-fuel ratio of each cylinder by the observer can be set to a smaller value as the engine rotational speed NE increases and/or the intake pipe absolute pressure PBA decreases. On the other hand, the gain can be set to a larger value as the engine rotational speed NE decreases/or and the intake pipe absolute pressure PBA increases.

Figure 6B:
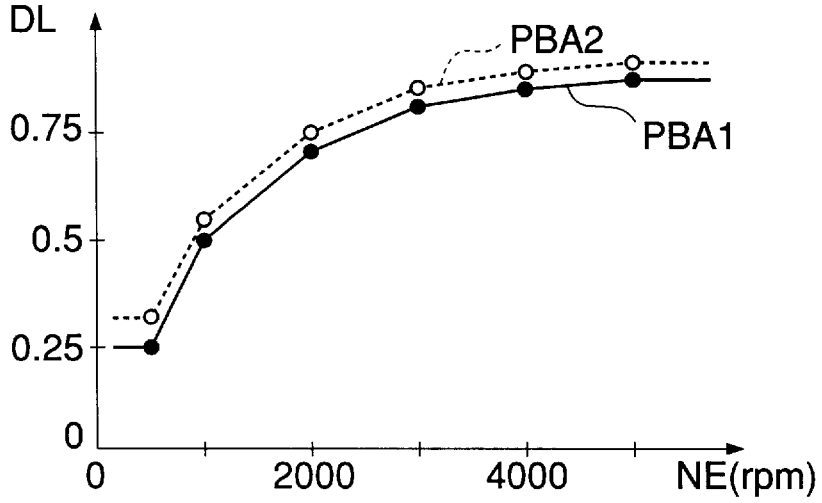
FIG. 6B shows a table for determining a response delay time constant DL for the LAF sensor.

The delay time constant DL is determined, as shown in FIG. 6B, from a DL table which is set according to the engine rotational speed NE and the intake pipe absolute pressure PBA. In the figure, PBA1 and PBA2 represent, for example, 660 mmHg and 260 mmHg respectively, and an interpolation is carried out when the NE and/or PBA value falls between the predetermined values. The DL table is set such that the DL value is set to a larger value as the NE value increases and/or the PBA value decreases. It has been empirically ascertained that the best compensation for the response delay of the LAF sensor 17 can be obtained if the time constant DL is set to a value corresponding to a time period longer than the actual response delay by approximately 20%.

As described hereinabove, according to the present embodiment, not only the weighting coefficient C but also the gain matrix K is set according to operating conditions of the engine. As a result, the stableness and convergence of the observer can be optimized to thereby improve the accuracy of estimation of the cylinder-by cylinder air-fuel ratio, irrespective of operating conditions of the engine.

Figure 8:
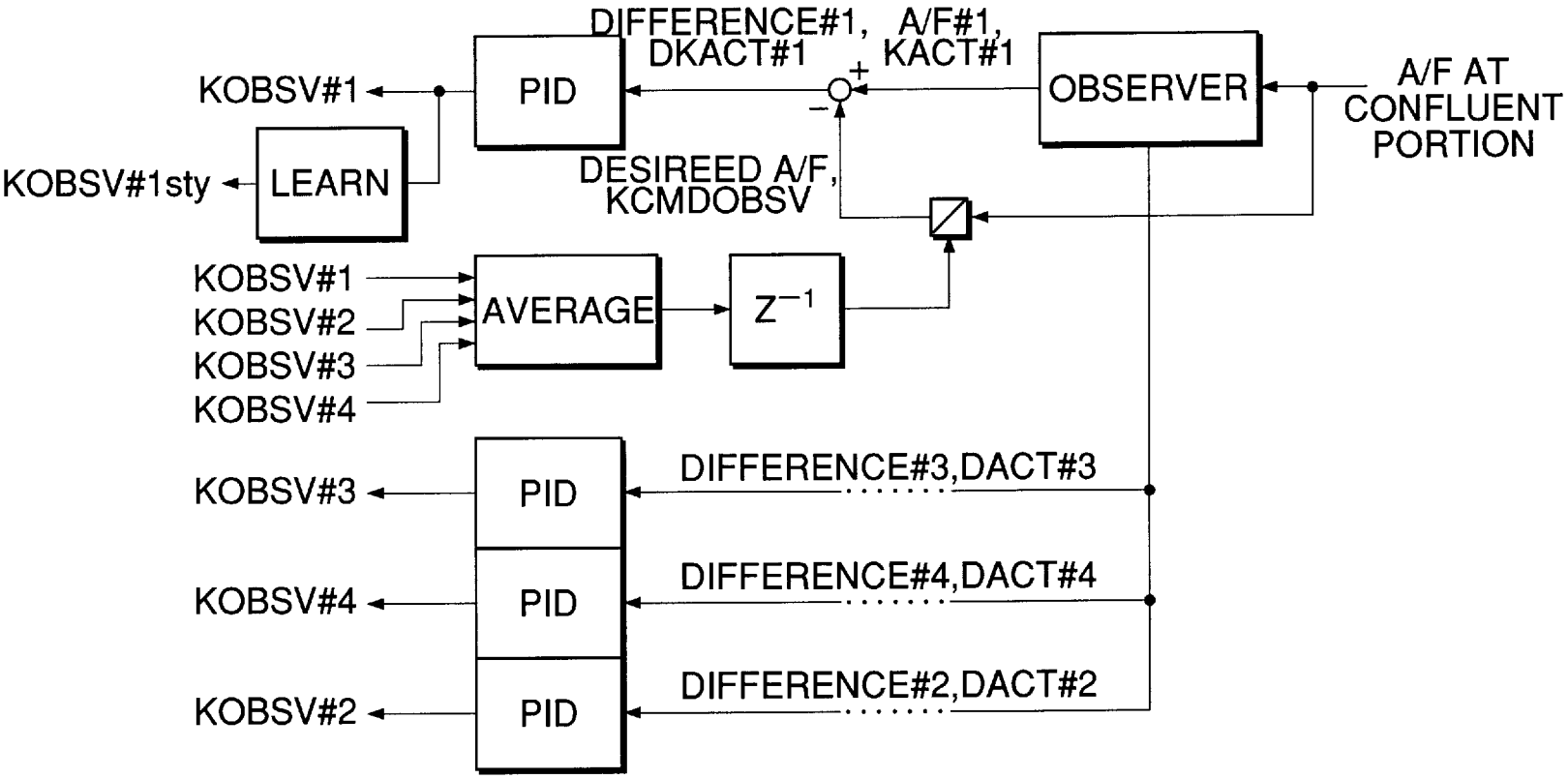
FIG. 8 is a diagram which is useful in explaining a manner of cylinder-by-cylinder air-fuel ratio feedback control.

Next, description will be made of the manner of calculating the cylinder-by-cylinder correction coefficient KOBSV#N, based on the thus estimated cylinder-by-cylinder air-fuel ratio, with reference to FIG. 8.

As shown in the following equation (12), the actual equivalent ratio KACT corresponding to the air-fuel ratio A/F at the confluent portion is divided by the immediately preceding value of an average value of the cylinder-by-cylinder correction coefficient KOBSV#N for all the cylinders, to thereby calculate a desired value KCMDOBSV (k) as an equivalent ratio corresponding to the desired air-fuel ratio. The cylinder-by-cylinder correction coefficient KOBSV#1 for the #1 cylinder is calculated by the PID control such that the difference DKACT#1(k) (=KACT#1 (k)−KCMDOBSV(k)) between the desired value KCMDOBSV(k) and the estimated equivalent ratio KACT#1(k) for the #1 cylinder becomes equal to zero:

$$KCMDOBSV(k) = KACT(k)/\left(\sum_{N=1}^{4} KOBSV\#N(k-1)/4\right) \tag{12}$$

More specifically, a proportional term KOBSVP#1, an integral term KOBSVI#1, and a differential term KOBSVD#1 for use in the PID control are calculated by the use of the respective following equations (13A), (13B), and (13C), to thereby calculate the cylinder-by-cylinder correction coefficient KOBSV#1 by the use of the following equation (14):

$$KOBSVP\#1(k) = KPOBSV \times DKACT\#1(K) \tag{13A}$$

$$KOBSVI\#1(k) = KIOBSV \times DKACT\#1(K) + KOBSVI\#1(k-1) \tag{13B}$$

$$KOBSVD\#1(k) = KDOBSV \times (DKACT\#1(K) - DKACT\#1(k-1)) \tag{13C}$$

$$KOBSV\#1(k) = KOBSVP\#1(k) + KOBSVI\#1(k) + KOBSVD\#1(k) + 1.0 \tag{14}$$

where KPOBSV, KIOBSV and KDOBSV represent a basic proportional term, a basic integral term, and a basic differential term, respectively.

The same calculations are carried out with respect to the cylinders #2 to #4, to obtain the cylinder-by-cylinder correction coefficients KOBSV#2 to KOBSV#4 therefor.

By this control operation, the air-fuel ratio of the mixture supplied to each cylinder is converged to the air-fuel ratio detected at the confluent portion of the exhaust system. Since the air-fuel ratio at the confluent portion is converged to the desired air-fuel ratio by the use of the PID correction coefficient KLAF, the air-fuel ratio values of mixtures supplied to all the cylinders can be eventually converged to the desired-air fuel ratio.

Further, the learned value KOBSV#Nsty of the cylinder-by-cylinder correction coefficient KOBSV#N is calculated for each operating region of the engine by the use of the following equation (15) and stored in the RAM, which is backed-up by a battery of the engine during stoppage of the engine:

$$KOBSV\#Nsty = Csty \times KOBSV\#N + (1-Csty) \times KOBSV\#Nsty \tag{15}$$

where Csty represents a weighting coefficient, and KOBSV#Nsty on the right side the immediately preceding learned value.

Figure 9:
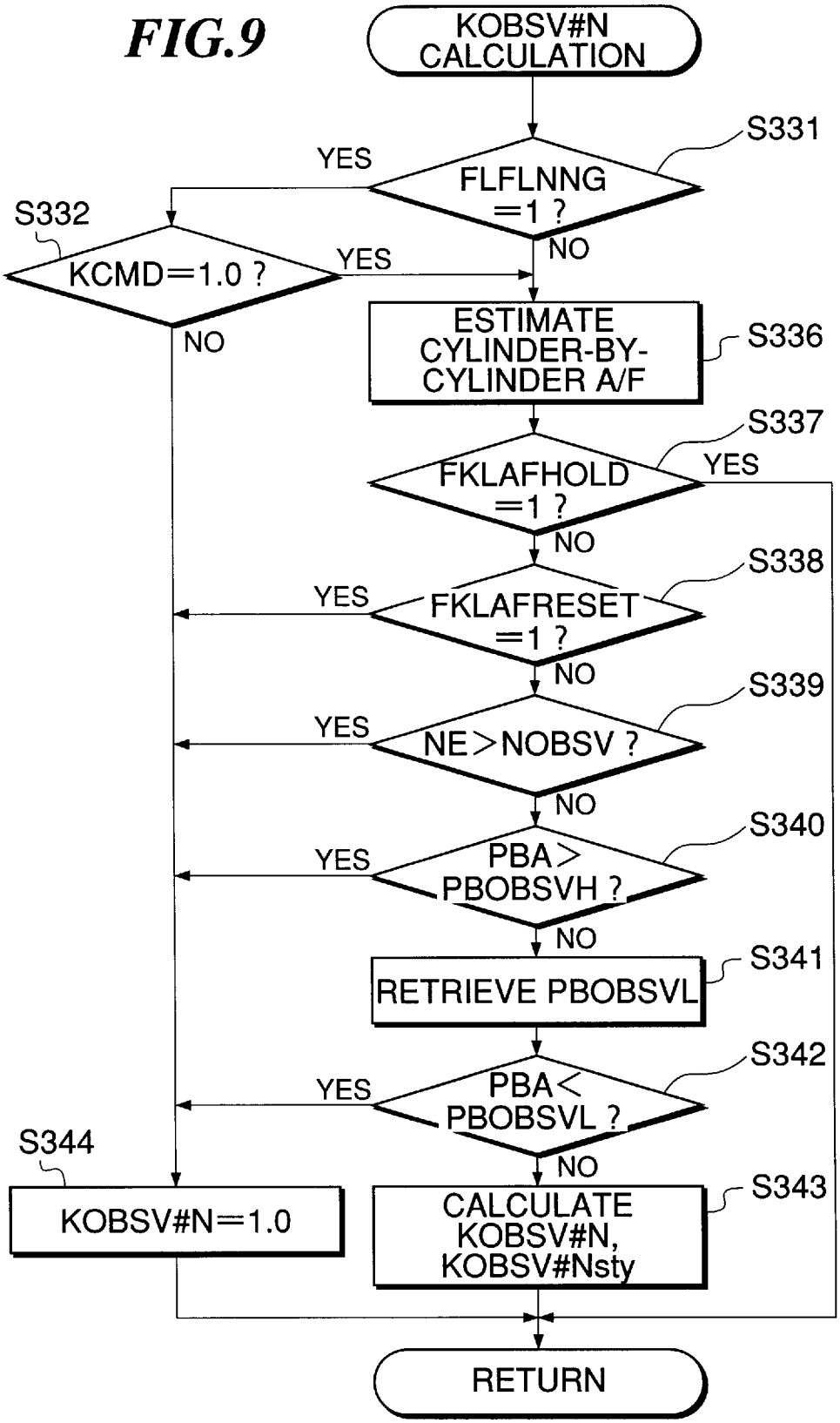
FIG. 9 is a flowchart showing a subroutine for calculating the cylinder-by-cylinder correction coefficient KOBSV#N, which is executed at a step S9 in FIG. 3.

FIG. 9 shows a subroutine for calculating the cylinder-by-cylinder correction coefficient KOBSV#N, which is executed at the step S9 in FIG. 3.

First, at a step S331, it is determined whether or not lean output deterioration of the LAF sensor 17 has been detected, and if the lean output deterioration has not been detected, the program proceeds to a step S336. On the other hand, if the lean output deterioration has been detected, it is determined at a step S332 whether or not the desired equivalent ratio KCMD is equal to 1.0, i.e. whether or not the desired air-fuel ratio assumes the stoichiometric air-fuel ratio. The lean output deterioration of the LAF sensor means such a deterioration of the LAF sensor that the output from the LAF sensor exhibited when the air-fuel ratio of the mixture is actually controlled to a leaner air-fuel ratio than the stoichiometric value deviates from a proper value by an amount larger than a predetermined amount. If KCMD=1.0 holds, the program proceeds to the step S336, whereas if KCMD≠1.0 holds, the cylinder-by-cylinder correction coefficient KOBSV#N for all the cylinders is set to 1.0 at a step S344, which means that the cylinder-by-cylinder feedback control is not executed, followed by terminating the present routine.

At the step S336, the cylinder-by-cylinder air-fuel ratio estimation by the observer described above is executed. Then, it is determined at a step S337 whether or not a hold flag FKLAFHOLD which, when set to "1", indicates that the PID correction coefficient KLAF should be held at the present value, assumes "1". If FKLAFHOLD=1 holds, the program is immediately terminated.

If FKLAFHOLD=0 holds at the step S337, it is determined at a step S338 whether or not the reset flag FKLAFRESET assumes "1". If FKLAFRESET=0 holds, it is determined at a step S339 whether or not the engine rotational speed NE is higher than a predetermined value NOBSV (e.g. 3500 rpm). If NE≦NOBSV holds, it is determined at a step S340 whether or not the intake pipe absolute pressure PBA is higher than a predetermined upper limit value PBOBSVH (e.g. 650 mmHg). If PBA≦PBOBSVH holds, a PBOBSVL table which is set according to the engine rotational speed NE, as shown in FIG. 11, is retrieved to determine a lower limit value PBOBSVL of the PBA value at a step S341, and then it is determined at a step S342 whether or not the PBA value is lower than the lower limit value PBOBSVL.

If any of the answers to the questions of the steps S338 to S340 and S342 is affirmative (YES), the program proceeds to the step S344, and therefore the cylinder-by-cylinder air-fuel ratio feedback control is not executed. On the other hand, if the answers to the questions of the steps S338 to S340 and S342 are all negative (NO), which means that the engine is in a operating condition corresponding to the shaded region in FIG. 11, it is determined that the cylinder-by-cylinder air-fuel ratio feedback control can be carried out. Therefore, the cylinder-by-cylinder correction coefficient KOBSV#N and the learned value KOBSV#Nsty thereof are calculated in the manner as described above at a step S343, followed by terminating the present program.

Figure 10:
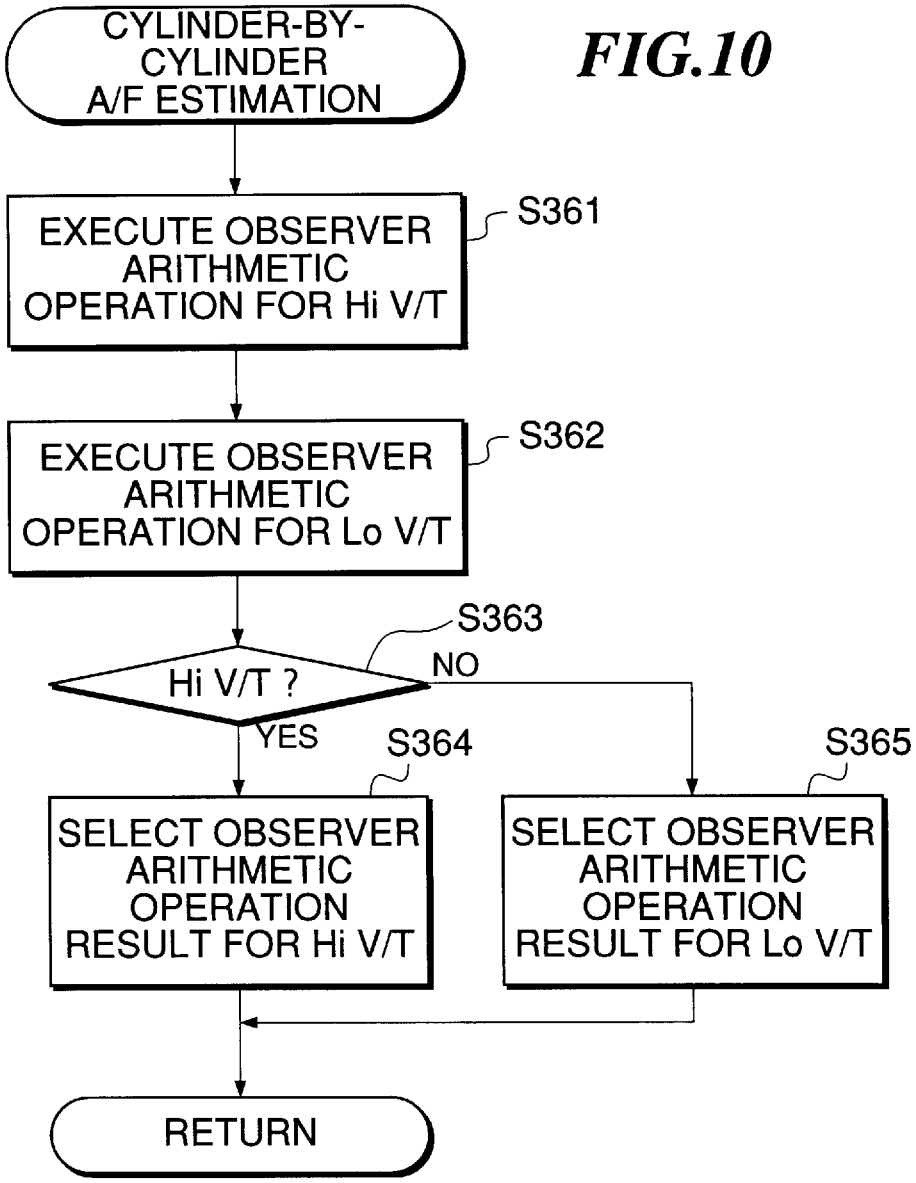
FIG. 10 is a flowchart showing a subroutine for carrying out a cylinder-by-cylinder air-fuel ratio-estimating process, which is executed at a step S336 in FIG. 9.

FIG. 10 shows a subroutine for estimating the cylinder-by-cylinder air-fuel ratio, which is executed at the step S336 in FIG. 9.

First, at a step S361, an arithmetic operation by the use of the observer (i.e. estimation of the cylinder-by-cylinder air-fuel ratio value) for the high-speed valve timing is carried out, and at the following step S362, an arithmetic operation by the use of the observer for the low-speed valve timing is carried out. Then, it is determined at a step S363 whether or not the present valve timing is set to the high-speed valve timing. If the present valve timing is set to the high-speed valve timing, a result of the observer arithmetic operation for the high-speed valve timing is selected at a step S364, whereas if the present valve timing is set to the low-speed valve timing, a result of the observer arithmetic operation for the low-speed valve timing is selected at a step S365.

The reason why the observer arithmetic operations for the high-speed valve timing and the low-speed valve timing are thus carried out before determining the present valve timing is that the estimation of the cylinder-by-cylinder air-fuel ratio requires several times of arithmetic operations before the estimation results are converged. By the above manner of estimation, it is possible to enhance the accuracy of estimation of the cylinder-by-cylinder air-fuel ratio immediately after changeover of the valve timing.

What is claimed is:

1. In a cylinder-by-cylinder air-fuel ratio-estimating system for an internal combustion engine having a plurality of cylinders, and an exhaust system including at least one confluent portion, the cylinder-by-cylinder air-fuel ratio-estimating system including air-fuel ratio-detecting means arranged in said exhaust system at said confluent portion, and cylinder-by-cylinder air-fuel ratio-estimating means for estimating an air-fuel ratio of a mixture supplied to each of said cylinders, based on an output from said air-fuel ratio-detecting means, by using an observer for observing an internal operative state of said exhaust system based on a model representative of a behavior of said exhaust system, the improvement wherein:

said cylinder-by-cylinder air-fuel ratio-estimating means changes a gain for use in the estimation of said air-fuel ratio of said mixture supplied to said each of said cylinders by said observer, according to operating conditions of said engine.

2. A cylinder-by-cylinder air-fuel ratio-estimating system as claimed in claim 1, wherein said engine has an intake system, said cylinder-by-cylinder air-fuel ratio-estimating means changing said gain for use in the estimation of said air-fuel ratio of said mixture supplied to said each of said cylinders by said observer, according to rotational speed of said engine and pressure within said intake system.

3. A cylinder-by-cylinder air-fuel ratio-estimating system as claimed in claim 2, wherein said cylinder-by-cylinder air-fuel ratio-estimating means sets said gain to a larger value as said rotational speed of said engine increases.

4. A cylinder-by-cylinder air-fuel ratio-estimating system as claimed in claim 3, wherein said cylinder-by-cylinder air-fuel ratio-estimating means sets said gain to a larger value as said pressure within said intake system decreases.

* * * * *